US006827557B2

(12) United States Patent
Kim

(10) Patent No.: US 6,827,557 B2
(45) Date of Patent: Dec. 7, 2004

(54) AMORPHOUS ALLOY POWDER CORE AND NANO-CRYSTAL ALLOY POWDER CORE HAVING GOOD HIGH FREQUENCY PROPERTIES AND METHODS OF MANUFACTURING THE SAME

(75) Inventor: Kyu-Jin Kim, 104-202, Sejong Apt., Jeonmin-dong, Yuseong-gu, Daejeon 305-390 (KR)

(73) Assignees: HumanElecs Co., Ltd., Daejeon (KR); Kyu-Jin Kim, Daejon (KR)

( * ) Notice: Subject to any disclaimer, the term of this patent is extended or adjusted under 35 U.S.C. 154(b) by 138 days.

(21) Appl. No.: 10/041,089

(22) Filed: Jan. 7, 2002

(65) Prior Publication Data

US 2002/0124914 A1 Sep. 12, 2002

(30) Foreign Application Priority Data

Jan. 5, 2001 (KR) ..... 10-2001-0000491
Feb. 16, 2001 (KR) ..... 10-2001-0007782

(51) Int. Cl.[7] ..... B22F 1/02
(52) U.S. Cl. ..... 417/35; 419/38; 419/39
(58) Field of Search ..... 419/35, 38, 39, 419/36, 37, 31, 29; 148/105

(56) References Cited

U.S. PATENT DOCUMENTS 4,608,297 A * 8/1986 Shimada et al. ..... 428/215
4,820,338 A * 4/1989 Ochiai et al. ..... 75/233
5,096,513 A * 3/1992 Sawa et al. ..... 148/304
6,063,209 A * 5/2000 Matsutani et al. ..... 148/300
6,284,060 B1 * 9/2001 Matsutani et al. ..... 148/300
6,302,972 B1 * 10/2001 Hirosawa et al. ..... 148/302
6,368,423 B1 * 4/2002 Otsuka et al. ..... 148/104
6,527,971 B1 * 3/2003 Nakamura et al. ..... 252/62.54

* cited by examiner

*Primary Examiner*—Daniel Jenkins
(74) *Attorney, Agent, or Firm*—Duane Morris LLP

(57) ABSTRACT

A method of manufacturing an amorphous alloy core including the steps of mixing an amorphous alloy powder with a solution made by dissolving a polyimide/phenolic resin binder in an organic solvent, evenly coating the binder in liquid phase on the surface of the alloy powder to make a powder of composite particles, molding the power of composite particles, and performing a heating treatment thereon. This invention also discloses a method of manufacturing a nano-crystal alloy core including the steps of (a) mixing an amorphous alloy powder with a solution made by dissolving a polyimide/phenolic resin binder in an organic solvent, evenly coating the binder in the liquid phase on the surface of the alloy powder to make composite particles, molding the composite particles at room temperature, and performing a heating treatment thereon at a temperature higher than the crystallization starting temperature of the alloy; and (b) performing a heating treatment on an amorphous alloy powder at over a crystallization starting temperature to make a nano-crystal phase, mixing a solution made by solving a polyimide/phenolic resin binder in an organic solvent therewith, evenly coating the binder in liquid phase on the surface of the alloy powder to make composite particles, and molding the power of composite particles at 100 to 300° C.

2 Claims, No Drawings

AMORPHOUS ALLOY POWDER CORE AND NANO-CRYSTAL ALLOY POWDER CORE HAVING GOOD HIGH FREQUENCY PROPERTIES AND METHODS OF MANUFACTURING THE SAME

BACKGROUND OF THE INVENTION (a) Field of the Invention

The present invention relates to an amorphous alloy powder core having excellent high frequency properties and a nano-crystal alloy powder core with excellent soft-magnetic properties in the high frequency band range, and also relates to methods of manufacturing the same. More specifically, the present invention relates to a method of manufacturing an amorphous alloy powder core with good high frequency properties that can be made by low-temperature compression molding, by using a small amount of a polyimide resin or a phenolic resin binder with a crystalline magnetic core material, with the further benefit that the production yield is enhanced. The present invention also relates to a method of manufacturing a nano-crystal alloy powder core with excellent saturated magnetic flux density and effective permeability by performing a heat treatment of an amorphous alloy powder or an amorphous alloy powder core at a temperature greater than the crystallization temperature of the alloy.

(b) Description of the Related Art

Generally, amorphous soft-magnetic alloys exhibit excellent corrosion resistance and abrasion resistance, as well as strength and permeability, and are used as magnetic materials for electric and electronic appliances. They can be applied to transformers, inductors, motors, generators, relays, etc. Such amorphous soft-magnetic alloys are quenched during manufacture in order to maintain the amorphous state, and are generally formed in the shape of thin bands or fine lines. To manufacture a core of a particular shape, the amorphous soft-magnetic alloy used to form the shape is first ground to powder and is then compressed under a given pressure at a given temperature.

The bulk molding of the amorphous soft-magnetic alloy powder should be carried out at a temperature lower than the crystallization point for the alloy so as to maintain its amorphous state. However, since it is impossible to bulk mold the alloy powder at such a temperature, a method of binding the amorphous soft-magnetic alloy powder has been employed, in which a glass powder with a lower vitrification point than that of the amorphous soft-magnetic alloy powder was added by means of a ball mill, after which the resulting powder was softened and pressed at a temperature of about 500° C. Hot isostatic pressing (HIP), and a hot press, etc. are generally used for the above method. There are other methods such as an explosive method, and an impact gun method, however special equipment is necessary to attain very high energy and the practice of these methods is time consuming, thus lowering the production yield.

Bulk molding of crystalline soft-magnetic alloy powder is carried out at a high temperature and uses, eg. a water glass as a binder. This is because the alloy powders are amenable to plastic deformation and strongly hold together during pressing at pressures of over 15 ton/cm$^2$, since the crystalline alloy is lower in strength than the amorphous alloy. This process causes fewer cracks and the heating treatment after molding can be conducted at a high temperature of about 800° C. to bring about the diffusion of atoms and to thereby attain stronger bonds between particles.

On the other hand, if one were to perform high-pressure molding of an amorphous alloy powder that has very high strength and ductility compared to the crystalline material, and were to use water glass as a binder, numerous cracks would be produced in the core. In addition, since the heating treatment that is carried out at below 500° C. does not bring about diffusion of atoms, the final core would be very low in strength and easily broken.

SUMMARY OF THE INVENTION

It is an object of the present invention to provide a method of manufacturing an amorphous alloy powder core with good high frequency properties that can be made through low-temperature compression molding by using a polyimide resin or a phenolic resin with higher viscosity than a conventional water glass as a binder, thereby reducing the amount of the required binder, and assuring a higher production yield than is achieved with hot isostatic pressing.

It is another object of the present invention to provide an amorphous alloy core having a high molding density and no surface cracks, and that exhibits a low dependence on frequencies and constant permeability even in the high frequency band range because of the improved insulative properties of the alloy core particles.

It is still another object of the present invention to provide a method of manufacturing a nano-crystal alloy powder core with excellent saturated magnetic flux density and enhanced effective permeability by heat treating an amorphous alloy powder at a temperature higher than the crystallization starting temperature of the alloy and by using a polyimide resin or a phenolic resin as a binder.

It is still another object of the present invention to provide a nano-crystal alloy powder core having a high molding density and no surface cracks, and showing a low dependence on frequencies and constant permeability even in the high frequency band range because of the improved insulative properties of the alloy core particles.

In order to achieve the above objects, the present invention provides a method of manufacturing an amorphous alloy core including the steps of mixing an amorphous alloy powder with a solution made by dissolving a polyimide/phenolic resin binder in an organic solvent, evenly coating the surface of the alloy powder with the binder in liquid phase to make composite particles, molding the composite particles, and performing a heat treatment thereon.

Preferably, the above method may further include the steps of heat treating the amorphous alloy powder at a temperature of less than 500° C. before mixing the amorphous alloy powder in the solution made by dissolving the polyimide resin or phenolic resin in the organic solvent.

Molding may be performed at a temperature of less than 200° C. and under a pressure of 10 to 50 ton/cm$^2$. The heat treatment is performed at 150 to 500° C.

The amorphous alloy core has a saturated magnetic flux density of more than 0.80T and a permeability of more than 0.90, measured in 1 MHz and 0.1 MHz.

According to another aspect of the present invention, a method of manufacturing a nano-crystal alloy core includes the steps of mixing an amorphous alloy powder with a solution made by solving a polyimide/phenolic resin binder in an organic solvent, evenly coating the surface of the alloy powder with the binder in liquid phase to form composite particles, molding the composite particles at a normal temperature. and performing a heating treatment thereon at a temperature that is higher than the crystallization starting temperature of the alloy.

According to still another aspect of the present invention, a method of manufacturing a nano-crystal alloy core includes the steps of heat treating an amorphous alloy powder at a temperature of over its crystallization starting temperature to form a nano-crystal phase, mixing a solution made by dissolving a polyimide/phenolic resin binder in an organic solvent therewith, evenly coating the surface of the alloy powder with the binder in liquid phase to make composite particles, and molding the composite particles at 100 to 300° C. The molding is performed under a pressure of 10 to 50 ton/cm$^2$ for less than 1 minute.

The resulting nano-crystal alloy core has a saturated magnetic flux density of more than 1.10T and a permeability of more than 0.90, as measured at 1 MHz and 0.1 MHz. The properties of the nano-crystal alloy core of the invention are enhanced by more than 20% compared to the amorphous alloy powder core of the same composition prepared by conventional methods.

DETAILED DESCRIPTION OF THE PREFERRED EMBODIMENTS

In the following detailed description, preferred embodiments of the invention have been shown and described, simply by way of illustration of the best mode contemplated by the inventor(s) of carrying out the invention. As will be realized, the invention is capable of modification in various obvious respects, all without departing from the spirit or essential characteristics of the invention.

The types of alloy powders, binders, their amounts, and the pressing conditions required for the practice of the methods of manufacturing amorphous alloy powder cores and nano-crystal alloy powder cores of this invention are similar throughout the steps in the manufacture of each core. The amorphous alloy powder can be made by a mechanical alloy process, a rapid solidification, a water injection process, and the like.

Suitable alloy powders include and may be selected from Fe based powders (Fe—Si—B based, Fe—Al—B based, etc.), Co based powders (Co—Fe—Si—B based) that are preferable alloy powders for the preparation of products in the amorphous state, and Fe—Si—B based powders, Fe—Al—B based powders, and the like, that are preferable alloy powders for the preparation of products characterized by nano-crystallization of amorphous powders through appropriate heating treatment. The crystallization temperature for these alloys is about 500° C. The preparation of an amorphous alloy powder by high pressure water injection comprises grinding a dropping stream of molten metal at a pressure of over 30 Mpa, and then quenching the stream. High pressure water injection results in higher product yield and suppression of crystallization in distinction to conventional techniques. Using high pressure water injection, one can manufacture amorphous alloy powders with various average diameters less than 100 $\mu$m in response to a variation of the injection conditions.

The vitrification point of the binder should be lower than the crystallization temperature of the amorphous alloy, and the binder must have a binding strength at a normal temperature that is sufficient to restrain generation of cracks, thereby retaining the shape of the core under the applied pressure at the normal temperature. It is preferable that a polyimide-based thermosetting resin or a phenol-based or phenolic thermosetting resin is used as a binder. Suitable polyimide resins include homopolymers and copolymeric formulations, with a particular non-limiting example of such a resin comprising ULTEM 1000, manufactured by GE Plastics. Suitable phenolic resins include phenol-formaldehyde, resorcinol-formaldehyde and the like, and by way of non-limiting illustration, a particular phenolic resin is KMB-100PLM manufactured by Kolon Chemical.

It is preferable that the amount of the binder ranges from 0.5 to 3.0 wt % of the total mass. It is hard to mold the alloy powder into a cohesive body if the amount of the binder is less than 0.5 wt % because of a weak binding strength. On the contrary, if the amount of the binder is too large, the amount of the alloy powder forming the final product is reduced, and its soft-magnetic properties are undesirably diminished even though the binding strength between the alloy powder particles becomes high. The above-described total mass refers to the mass of all the binder and alloy powder forming the core, and does not include the mass of an organic solvent.

It is preferable that a pressure of 10 to 50 ton/cm$^2$ is required for molding an alloy powder manufactured by mixing a binder therein. If the pressure is less than 10 ton/cm$^2$, the density of the core becomes too low and the soft magnetic property of the core is degraded. If the pressure is too high, the die surface is greatly abraded and its useful life is reduced, and the production cost is thus increased.

In the manufacture of the inventive amorphous/nano-crystal alloy powder products having excellent high frequency properties, manufacturing conditions such as molding temperature, the temperature for the heat treatment of the core, and the like, may vary with regard to the particular amorphous or nano-crystal alloy powder core under preparation.

First, it is preferable that the molding temperature for manufacturing the inventive amorphous alloy powder core is lower than 200° C. The higher the pressing temperature is, the higher the molding density of the core becomes as a function of the increased density of the powder particles. If the temperature is higher than 200° C., the energy cost becomes high, which is not preferable.

The temperature for the heating treatment in the manufacture of the inventive amorphous alloy powder core varies with the components of the amorphous alloy and temperatures required for previous treatments, and is preferably 150 to 500° C., which is lower than the crystallization temperature by 50 to 200° C. If the temperature is too low, the internal stress produced during molding is not fully removed. If the temperature is too high, phase transformation from the amorphous state and the formation of crystal structures may occur. The heat treatment is carried out in an ambient atmosphere of inert gas or reducing gas for a period of time or from 5 to 60 minutes. If the period of time for the heating treatment is too short, the stress is not fully removed, with the result that the heat treatment would be undesirably prolonged and the production yield would be decreased.

The following describes the manufacture of a nano-crystal alloy powder core with excellent soft-magnetic properties in the high frequency band range. In the method of manufacturing a core by (a) performing a heating treatment on an amorphous alloy powder at temperature above the crystallization starting temperature to make a nano-crystal alloy powder, mixing it with a solution made by dissolving a polyimide/phenolic resin binder in an organic solvent, and evenly coating the binder in liquid phase on the surface of the above alloy powder to make a powder of composite particles. The heat treatment temperature is preferably higher than the vitrification point of the binder. If the temperature is high, the molding density of the core and the density of the particles become high, and if it is higher than 300° C., the energy cost becomes high. The temperature for the heating treatment is higher than the crystallization starting point and particularly, is up to but less than 100° C., and more preferably by 50° C.

Generally, the heating treatment for metal alloys is preferably performed at about 500 to 600° C. If the temperature for the heating treatment is too far above the crystallization starting temperature, the crystal phase becomes abruptly coarse, and the binder is abruptly dissolved, thus decreasing the bond strength between the particles. If the temperature is lower than the crystallization starting point, a nano-crystal phase is hardly produced. Preferably, the heating treatment is performed in an ambient atmosphere of a reducing gas for a period of time of from 10 to 60 minutes. If the time for the heating treatment is too short, the stress cannot be fully removed, with the result that the heat treatment would be undesirably prolonged and the production yield would be decreased.

The following describes the manufacture of a nano-crystal alloy powder core with excellent soft-magnetic properties in the high frequency band range. In the method of manufacturing such a nano-crystal alloy powder core by (b) mixing an amorphous alloy powder with a solution made by dissolving a polyimide/phenolic resin binder in an organic solvent, evenly coating the binder in liquid phase on the surface of the alloy powder to make a powder of composite particles, molding the composite particles at a normal temperature, and then heat treating the amorphous alloy powder at a temperature higher than its crystallization starting temperature i.e. the temperature at which crystallization begins, more particularly, the temperature required for the heat treatment is higher than the crystallization starting point (e.g. by about 100° C.), and preferably, by 50° C. Generally, the heat treatment of the metal alloy is preferably performed at about 500 to 600° C. The following non-limiting examples are presented to illustrate the practice of the present invention.

EXAMPLES OF PREPARATION OF INVENTIVE AMORPHOUS ALLOY POWDER CORES

Example 1

A solution made by dissolving 1 g of a polyimide resin (ULTEM 1000, GE Plastic) in a 100 cc solution of methylene chloride is combined with $Fe_{73}Si_{13}B_{10}Nb_3Cu_1$ amorphous alloy powder (average diameter about 15 μm) of 99 g prepared by a high pressure water injection process, and the resulting combination is mixed for about 10 minutes. The mixture is then dried, thus yielding a powder of composite particles with polyimide evenly coated on their surface to a thickness of less than 1 μm. The particles have an average diameter of 15 μm.

A quantity of the composite particles (7 g) is inserted into a die with an outer diameter of 20 mm and an inner diameter of 12 mm and molded under a pressure of 20 ton/cm$^2$ at room temperature, and then thermally treated at 450° C. for 30 minutes in an ambient atmosphere of Ar gas, thus making an amorphous core. The properties of the amorphous core, i.e. density, generation of cracks, saturated magnetic flux density, effective permeability in various frequency bands, and permeability ratio ($\mu_{1\ MHz}/\mu_{0.1\ MHz}$) are shown in Table 1. The density of the core is a value obtained by dividing the actual mass of the core by its volume, and the saturated magnetic flux density ($B_s$) is measured under an external magnetic field of 5,000 Oe by using a vibrating sample magnetometer (VSM). The effective permeability is measured in each frequency band under an external magnetic field of 10 mOe by using an LCR meter. The permeability ratio ($\mu_{1\ MHz}/\mu_{0.1\ MHz}$) is a ratio of permeability values measured in 1 MHz and 0.1 MHz.

Example 2

This example is carried out under the same conditions as those of Example 1 except that a solution is made by dissolving 0.5 g of the polyimide resin in a solution of 100 cc methylene chloride. The properties manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 3

This example is carried out under the same conditions as those of Example 1 except that a solution is made by dissolving 1.5 g of the polyimide in a 100 cc solution of methylene chloride. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 4

This example is carried out under the same conditions as those of Example 1 except that the molding pressure at room temperature is 10 ton/cm$^2$. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 5

This example is carried out under the same conditions as those of Example 1 except that the pressure at room temperature is 40 ton/cm$^2$. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 6

An amount of 99 g of $Fe_{73}Si_{13}B_{10}Nb_3Cu_1$ amorphous alloy powder (average diameter about 15 μm) prepared by a high pressure water injection process is thermally treated at 450° C. for 30 minutes in an ambient atmosphere of Ar gas, and air cooling is then performed thereon at room temperature. A solution made by dissolving 1 g of a phenol resin (KMB-100PLM, KOLON Chemical) in 100 cc of methyl alcohol is mixed therewith for 10 minutes. The mixture is then dried, thus yielding a powder of composite particles with phenol evenly coated on the surface of the amorphous alloy powder (average diameter 15 μm) to a thickness of less than 1 μm.

A quantity of 7 g of composite particles is inserted into a die with an outer diameter of 20 mm and an inner diameter of 12 mm, and is molded under a pressure of 20 ton/cm$^2$ at room temperature, and is then thermally treated at 150° C. for 10 minutes in an ambient atmosphere of Ar gas, thus making an amorphous core. The properties of the amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 7

This example is carried out under the same conditions as those of Example 6 except that a solution is made by dissolving 0.5 g phenol in 100 cc of methyl alcohol. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 8

This example is carried out under the same conditions as those of Example 6 except that a solution is made by dissolving 1.5 g phenol in 100 cc of methyl alcohol. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 9

This example is carried out under the same conditions as those of Example 6 except that the temperature of the die is kept at 150° C. and the next heating treatment is omitted. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

Example 10

This example is carried out under the same conditions as those of Example 6 except that an amorphous alloy powder having the same composition as that of the alloy of Example 1 was used that was thermally treated at 450° C. for 30 minutes in an ambient atmosphere of $H_2$ gas, and air cooling was performed thereon at room temperature. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 1.

TABLE 1

| Example | Density (g/cm$^2$) | Generation of Cracks | Saturated Magnetic Flux Density | Effective Permeability ($\mu$) 0.1 MHz | 0.5 MHz | 1 MHz | Permeability Ratio $\mu_{1\ MHz}/\mu_{0.1\ MHz}$ |
|---|---|---|---|---|---|---|---|
| 1 | 5.74 | No | 0.90 T | 45.2 | 45.0 | 44.7 | 0.99 |
| 2 | 5.83 | No | 0.91 T | 51.1 | 51.0 | 50.6 | 0.99 |
| 3 | 5.67 | No | 0.90 T | 43.0 | 43.0 | 42.8 | 1.00 |
| 4 | 4.90 | No | 0.80 T | 35.0 | 35.0 | 34.7 | 1.00 |
| 5 | 6.16 | No | 0.96 T | 97.5 | 97.5 | 91.9 | 0.94 |
| 6 | 5.73 | No | 0.89 T | 44.7 | 44.7 | 44.0 | 0.98 |
| 7 | 5.87 | No | 0.91 T | 56.0 | 56.0 | 54.5 | 0.96 |
| 8 | 5.68 | No | 0.90 T | 42.2 | 42.2 | 42.0 | 1.00 |
| 9 | 5.93 | No | 0.92 T | 61.7 | 61.7 | 59.2 | 0.95 |
| 10 | 5.74 | No | 0.85 T | 47.8 | 47.8 | 47.3 | 1.00 |

Referring to Table 1, the saturated magnetic flux density in all of the illustrated examples is about 0.90T, and higher than 0.8T, an average of the well-known crystalline soft-magnetic alloy powder core. There is little permeability change in the frequency band from 0.1 MHz to 1 MHz. The permeability ratio of this core is over 0.90 in the frequency band of 1 MHz and 0.1 MHz, and shows the low dependence of the inventive core on frequencies, which means that this amorphous core can be used to 1 MHz. When comparing it with a conventional metal crystal core, the inventive core is similar to or superior to the metal crystal core in magnetic properties (saturated magnetic flux density and permeability), and its effective permeability ratio is over 0.90 in the frequency band to 1 MHz. Therefore, the inventive core can be used in tens of megahertz whereas the metal crystal core's appropriate frequency band is 200 kHz.

Comparative Examples of Preparations of Amorphous Alloy Powder Cores

Comparative Example 11

This comparative is carried out under the same conditions as those of Example 1 except that a solution is made by dissolving 0.3 g of the polyimide of Example 1 in a 100 cc solution of methylene chloride. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 2.

Comparative Example 12

This comparative example is carried out under the same conditions as those of Example 1 except that a solution is made by dissolving 3.2 g polyimide in a 100 cc solution of methylene chloride. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 2.

Comparative Example 13

This comparative example is carried out under the same conditions as those of Example 1 except that the molding pressure at room temperature is 5 ton/cm$^2$. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 2.

Comparative Example 14

This comparative example is carried out under the same conditions as those of Example 6 except that the solution is made by dissolving 0.3 g phenol in 100 cc of methyl alcohol. The manufactured properties of the amorphous core, i.e. density, generation of cracks, saturated magnetic flux density, effective permeability in various frequency bands, and permeability ratio ($\mu_{1\ MHz}/\mu_{0.1\ MHz}$) are shown in Table 2.

Comparative Example 15

This comparative example is carried out under the same conditions as those of Example 6 except that a solution is made by dissolving 3.2 g phenol in 100 cc of methyl alcohol. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 2.

TABLE 2

| Comparative Example | Density (g/cm$^2$) | Generation of Cracks | Saturated Magnetic flux Density | Effective Permeability ($\mu$) 0.1 MHz | 0.5 MHz | 1 MHz | Permeability Ratio $\mu_{1\ MHz}/\mu_{0.1\ MHz}$ |
|---|---|---|---|---|---|---|---|
| 11 | 4.85 | Numerous Cracks | 0.78 T | 17.6 | 17.6 | 17.6 | 1.00 |
| 12 | 4.90 | NO | 0.88 T | 26.7 | 26.7 | 26.7 | 1.00 |
| 13 | 4.50 | NO | 0.70 T | 17.3 | 17.3 | 17.3 | 1.00 |
| 14 | 4.86 | Numerous Cracks | 0.78 T | 16.4 | 16.4 | 16.4 | 1.00 |
| 15 | 4.87 | NO | 0.88 T | 27.2 | 27.2 | 27.2 | 1.00 |

Referring to Table 2, numerous cracks were generated in certain of the comparative cores (see Examples 11 and 14), and the effective permeability and saturated magnetic flux density were abruptly decreased.

Preparations of Inventive Nano-crystal Alloy Cores

Example 16

A solution made by dissolving 1 g of the polyimide used in Example 1 in a 100 cc solution of methylene chloride and combining such solution with 99 g $Fe_{73}Si_{13}B_{10}Nb_3Cu_1$ amorphous alloy powder (average diameter about 15 $\mu$m) prepared by a high pressure water injection process, following which the resulting combination is mixed for about 10 minutes. The mixture is then dried, thus yielding composite particles of amorphous alloy powder with polyimide evenly coated on their surface to a thickness of less than 1 $\mu$m, the particles having an average diameter of 15 $\mu$m.

Next, 7 g of the powder of composite particles is inserted into a die with an outer diameter of 20 mm and an inner diameter of 12 mm and molded under a pressure of 20 ton/cm$^2$ at a room temperature, and then thermally treated at 560° C. for 30 minutes in an ambient atmosphere of Ar gas, to form the nano-crystal core. The properties of the nano-crystal core, i.e. density, generation of cracks, saturated magnetic flux density, effective permeability in various frequency bands, and permeability ratio ($\mu_{1\ MHz}/\mu_{0.1\ MHz}$) are shown in Table 3.

The crystallization starting temperature for the amorphous powder is measured by heating at a heating speed of 2° C./min through a differential temperature analysis (DTA). The average size of a crystal grain is the value of the average diameter measured by X-ray diffraction (XRD) and a transmission electron microscope (TEM). The density of the core is the value obtained by dividing the core's actual mass by the core's volume, and the saturated magnetic flux density ($B_s$) is measured under an external magnetic field of 5,000 Oe by using VSM. Effective permeability is measured in each frequency band under an external magnetic field of 10 mOe by using an LCR meter. The permeability ratio ($\mu_{1\ MHz}/\mu_{0.1\ MHz}$) is aa ratio of permeability values measured at 1 MHz and 0.1 MHz.

Example 17

This example is carried out under the same conditions as those of Example 16 except that 99 g $Fe_{80}Al_4B_{10}Zr_5Cu_1$ amorphous alloy powder (average diameter about 12 $\mu$m) prepared by the high pressure water injection process is thermally treated at 500° C. for 30 minutes in an ambient atmosphere of Ar gas.

Example 18

In this example 99 g of $Fe_{80}Al_4B_{10}Zr_5Cu_1$ amorphous alloy powder (average diameter about 12 $\mu$m) prepared by a high pressure water injection process, is thermally treated at 500° C. for 30 minutes in an ambient atmosphere of Ar gas, and is then air cooled at room temperature. A solution made by dissolving 1 g of phenol in 100 cc of methyl alcohol is mixed therewith for 10 minutes. The mixture is then dried, yielding composite particles having an average diameter of 12 $\mu$m, with phenol evenly coated to a thickness of less than 1 $\mu$m. on the surface of the amorphous alloy powder.

Seven grams of composite particles are inserted into a die with an outer diameter of 20 mm and an inner diameter of 12 mm, and molded under a pressure of 20 ton/cm$^2$ at 150° C., thus forming an amorphous core.

The properties of the amorphous core, i.e. density, generation of cracks, saturated magnetic flux density, effective permeability in various frequency bands, and permeability ratio ($\mu_{1\ MHz}/\mu_{0.1\ MHz}$) are shown in Table 3.

Example 19

This example is carried out under the same conditions as those of Example 16 except that the molding pressure is 40 ton/cm$^2$.

Example 20

This example is carried out under the same conditions as those of Example 18 except that the molding pressure is 40 ton/cm$^2$.

Comparative Preparations of Nano-crystal Alloy Cores

Comparative Example 21

This comparative example is carried out under the same conditions as those of Example 16 except that the heating treatment for the core is performed at 500° C. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 3.

Comparative Example 22

This comparative example is carried out under the same conditions as those of Example 17 except that the heating treatment for the core is performed at 450° C. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 3.

Comparative Example 23

This comparative example is carried out under the same conditions as those of Example 16 except that the heating treatment for the core is performed at 650° C. The properties of the manufactured amorphous core, i.e. density, generation of cracks, saturated magnetic flux density, effective permeability in various frequency bands, and permeability ratio ($\mu_{1\ MHz}/\mu_{0.1\ MHz}$) are shown in Table 3.

TABLE 3

| Example/ Comparative Example | Crystallization Starting point (° C.) | Temperature for heating treatment (° C.) | Average crystal diameter (nm) | Density of Core (g/cm$^2$) | Saturated Magnetic Flux Density ($B_B$) | Effective Permeability ($\mu_{eff}$) 0.1 MHz | 0.5 MHz | 1 MHz | Permeability Ratio $\mu_{1\ MHz}/\mu_{0.1\ MHz}$ |
|---|---|---|---|---|---|---|---|---|---|
| 16 | 520 | 560 | 15 | 5.83 | 1.10 T | 67.0 | 66.8 | 65.0 | 0.97 |
| 17 | 470 | 500 | 17 | 5.85 | 1.35 T | 63.3 | 63.0 | 62.0 | 0.98 |
| 18 | 470 | 500 | 17 | 5.79 | 1.31 T | 62.1 | 62.0 | 60.9 | 0.98 |
| 19 | 520 | 500 | 17 | 6.25 | 1.39 T | 146.7 | 144.5 | 135.0 | 0.92 |
| 20 | 470 | 500 | 17 | 6.20 | 1.38 T | 134.4 | 132.2 | 125.0 | 0.93 |
| 21 | 520 | 500 | — | 5.75 | 0.90 T | 45.2 | 45.0 | 44.7 | 0.99 |
| 22 | 470 | 450 | — | 5.76 | 1.10 T | 42.6 | 42.3 | 42.1 | 0.99 |
| 23 | 470 | 650 | 45 | 5.86 | 1.40 T | 49.5 | 49.0 | 46.2 | 0.93 |

Referring to Table 3, the saturated magnetic flux density is over 1.10T in all the preferred embodiments, and the properties of the nano-crystal alloy cores are enhanced by more than 20% compared to the amorphous alloy powder cores of the same composition (Examples 21–23) that were thermally treated below the crystallization temperature. The effective permeability in 1 MHz is over 60.0, and its permeability is enhanced by more than 20% compared to the amorphous soft-magnetic alloy powder core composition thermally treated at below the crystallization temperature.

There is little permeability change in the frequency band from 0.1 MHz to 1 MHz. The permeability ratio of this nano-crystal alloy core is over 0.90 in the frequency band of 1 MHz and 0.1 MHz, and shows the low dependence of the inventive core on frequencies, which means that this amorphous core can be used to 1 MHz. When comparing it with a metal crystal core, the inventive core is similar to or superior to the metal crystal core in magnetic properties (saturated magnetic flux density and permeability), and its effective permeability ratio is over 0.90 in the frequency band to 1 MHz. Therefore, the inventive core can be used in tens of megahertz whereas the metal crystal core's appropriate frequency band is 200 kHz.

As the core (Comparative Example 23) thermally treated at the temperature higher than the crystallization starting temperature by 180° has a coarse average crystal diameter, its saturated magnetic flux density is almost the same as the inventive nano-crystal alloy core and its permeability is significantly degraded.

The inventive amorphous alloy powder core/nano-crystal alloy powder core exhibits excellent high frequency properties has a high molding density without surface cracking, and shows the satisfactory insulation of particles and low dependence on frequencies. In addition, the inventive amorphous alloy powder core/nano-crystal alloy powder core has a constant permeability in the high frequency band range, and can be used in magnetic materials for electric and electronic devices in the frequency band from several kilohertz to tens of megahertz.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A method of manufacturing an amorphous alloy core comprising the steps of:

mixing an amorphous alloy powder with a solution, the amorphous alloy powder having an average diameter of less than 10 $\mu$m and selected from the group consisting of Fe—Si—B based alloys and Fe—Al—B based alloys made by high pressure water injection, the solution made by dissolving a polyimide resin binder ranging from 0.5 to 3.0 wt % of the total mass in an organic solvent, evenly coating the binder in liquid phase on the surface of the alloy powder to make a powder of composite particles;

molding the powder of composite particles at a temperature of 50 to 300° C. under a pressure of 30 ton/cm$^2$; and performing a heating treatment at a temperature more than 10° C. lower than a crystallization starting temperature of said amorphous alloy.

2. A method of manufacturing a nano-crystal alloy core having a saturated magnetic flux density of more than 1.10T and a permeability of more than 0.90, measured between 1 MHz and 0.1 MHz, the method comprising the steps of:

mixing an amorphous alloy powder with a solution, the amornhous alloy powder having an average diameter of less than 10 $\mu$m and selected from the group consisting of Fe—Si—B based alloys and Fe—Al—B based allow made by high pressure water injection, the solution made by dissolving a polyamide resin binder ranging from 0.5 to 3.0 wt % of the total mass in an organic solvent, evenly coating the binder in liquid phase on the surface of the alloy powder to make a powder of composite particles;

molding the powder of composite particles at a temperature of 50 to 300° C. under a pressure of 10 to 30 ton/cm$^2$; and performing a heating treatment at a temperature less than 100° C. higher than a crystallization starting temperature of said amorphous alloy.

* * * * *